US009286800B2

(12) United States Patent
Gordon

(10) Patent No.: US 9,286,800 B2
(45) **Date of Patent: *Mar. 15, 2016**

(54) GUIDANCE ASSIST VEHICLE MODULE

(71) Applicant: Robert Gordon, Plainview, NY (US)

(72) Inventor: Robert Gordon, Plainview, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/558,381

(22) Filed: Dec. 2, 2014

(65) Prior Publication Data

US 2015/0235556 A1 Aug. 20, 2015

Related U.S. Application Data

(63) Continuation-in-part of application No. 14/108,710, filed on Dec. 17, 2013, now Pat. No. 9,053,636.

(60) Provisional application No. 61/911,298, filed on Dec. 3, 2013, provisional application No. 61/747,331, filed on Dec. 30, 2012, provisional application No. 61/750,426, filed on Jan. 9, 2013, provisional application No. 61/827,067, filed on May 24, 2013.

(51) Int. Cl.

| | |
|---|---|
| ***G08G 1/09*** | (2006.01) |
| ***G08G 1/0967*** | (2006.01) |
| ***G08G 1/16*** | (2006.01) |

(52) U.S. Cl.

CPC ..... *G08G 1/096775* (2013.01); *G08G 1/09* (2013.01); *G08G 1/167* (2013.01)

(58) Field of Classification Search

CPC ..... G08G 1/096775; G08G 1/096716; G08G 1/0962; G08G 1/096725; G08G 1/0116; G08G 1/0141; G08G 1/09; G08G 1/167

See application file for complete search history.

(56) References Cited

U.S. PATENT DOCUMENTS

| | | | | |
|---|---|---|---|---|
| 5,420,794 | A | 5/1995 | James | |
| 5,504,482 | A | 4/1996 | Schreder | |
| 5,689,252 | A | 11/1997 | Ayanoglu et al. | |
| 5,875,412 | A | 2/1999 | Sulich et al. | |
| 6,141,710 | A | 10/2000 | Miesterfeld | |
| 6,298,302 | B2 | 10/2001 | Walgers et al. | |
| 6,314,360 | B1 | 11/2001 | Becker | |
| 6,411,889 | B1 * | 6/2002 | Mizunuma | G08G 1/017 701/117 |
| 6,411,898 | B2 * | 6/2002 | Ishida | 348/118 |

(Continued)

OTHER PUBLICATIONS

Brian Smith and Ramkumar Venkatanarayana, System Operations Data Integrity Assessment, University of Virginia Center for Transportation Studies Report No. UVACTS-14-5-129, Jun. 25, 2007.

(Continued)

*Primary Examiner* — Tuan C. To
*Assistant Examiner* — Dale W Hilgendorf
(74) *Attorney, Agent, or Firm* — Law Offices of Leo Mikityanskiy, P.C.; Leonid Mikityanskiy

(57) ABSTRACT

The automated lane management assist method, data structure and system receive unprocessed lane-specific limited-access highway information, including lane use and speed limits, from freeway transportation management centers or traffic management centers, process and convert the unprocessed information to a form that assists in the selection of driving lanes and target speeds for vehicles, and communicate the processed information to the vehicles by suitable means. The Guidance Assist Vehicle Module combines the processed information with information from the vehicle and the driver including the information on appropriate lane changes and speed commands to the vehicle.

20 Claims, 7 Drawing Sheets

(56) References Cited

U.S. PATENT DOCUMENTS

| | | | | |
|---|---|---|---|---|
| 6,466,862 | B1 * | 10/2002 | DeKock | G08G 1/0962 701/117 |
| 6,785,606 | B2 * | 8/2004 | DeKock | G08G 1/0962 701/117 |
| 6,853,915 | B2 | 2/2005 | Hubschneider et al. | |
| 6,868,331 | B2 | 3/2005 | Hanebrink | |
| 6,873,908 | B2 | 3/2005 | Petzold et al. | |
| 7,092,815 | B2 * | 8/2006 | Dort | G08G 1/096775 701/117 |
| 7,317,973 | B2 | 1/2008 | Dieterle | |
| 7,421,334 | B2 | 9/2008 | Dahlgren et al. | |
| 7,471,212 | B2 | 12/2008 | Krautter et al. | |
| 7,483,786 | B1 | 1/2009 | Sidoti et al. | |
| 7,590,489 | B2 | 9/2009 | Auger et al. | |
| 7,593,809 | B2 * | 9/2009 | Rosen | G08G 1/20 701/117 |
| 7,593,813 | B2 | 9/2009 | Hahlweg et al. | |
| 7,725,250 | B2 | 5/2010 | Bisdikian et al. | |
| 7,930,095 | B2 | 4/2011 | Lee | |
| 7,974,772 | B2 | 7/2011 | Nitz et al. | |
| 8,099,236 | B2 | 1/2012 | Olson et al. | |
| 8,103,435 | B2 | 1/2012 | Yang et al. | |
| 8,155,865 | B2 | 4/2012 | Bicego, Jr. | |
| 8,311,727 | B2 | 11/2012 | Eckstein et al. | |
| 8,326,474 | B2 | 12/2012 | Schrey et al. | |
| 8,332,132 | B2 | 12/2012 | Groenhuijzen et al. | |
| 8,346,430 | B2 | 1/2013 | Przymusinski et al. | |
| 9,053,636 | B2 * | 6/2015 | Gordon | G08G 1/096775 |
| 2004/0246147 | A1 | 12/2004 | von Grabe | |
| 2004/0249562 | A1 | 12/2004 | Tsuge et al. | |
| 2005/0043880 | A1 * | 2/2005 | Yamane | G01C 21/26 701/414 |
| 2005/0131627 | A1 | 6/2005 | Ignatin | |
| 2005/0192033 | A1 | 9/2005 | Videtich | |
| 2006/0069496 | A1 | 3/2006 | Feldman et al. | |
| 2006/0247844 | A1 | 11/2006 | Wang et al. | |
| 2007/0050133 | A1 * | 3/2007 | Yoshikawa | G01C 21/3658 701/437 |
| 2007/0208492 | A1 | 9/2007 | Downs et al. | |
| 2007/0213924 | A1 * | 9/2007 | Nagase | G08G 1/096861 701/414 |
| 2008/0114530 | A1 * | 5/2008 | Petrisor | G08G 1/096775 701/117 |
| 2009/0287401 | A1 | 11/2009 | Levine et al. | |
| 2010/0256898 | A1 | 10/2010 | Gassner | |
| 2012/0083995 | A1 | 4/2012 | Vorona | |
| 2013/0282264 | A1 * | 10/2013 | Bastiaensen | G08G 1/167 701/119 |

OTHER PUBLICATIONS

Shawn Turner, Rich Margiotta and Tim Lomax, Monitoring Urban Freeways in 2003: Current Conditions and Trends from Archived Operations Data, Federal Highway Administration Report No. FHWA-HOP-05-018, Dec. 2004.

The University of Southern Queensland, Design Parameteres—Speed, available on the Internet at http://www.usq.edu.au/course/material/SVY2301/CIV2701/Lectures/Lectures%207-%20CIV2701-%20Design%20Factors%20-%20Speed.pdf.

Kazi Iftekhar Ahmed, Modeling Drivers 'Acceleration and Lane Changing Behavior, Doctoral Thesis, MIT, Feb. 1999.

S.M. Chin, O. Franzese, D.L. Greene, and H.L. Hwang, Temporary Loss of Highway Capacity and Impacts on Performance, Phase 2, Oak Ridge National Laboratory, Nov. 2004.

Suzanne E. Lee, Erik C.B. Olsen, and Walter W. Wierwille, A Comprehensive Examination of Naturalistic Lane Changes, USDOT Report No. DOT HS 809702, Mar. 2004.

* cited by examiner

GUIDANCE ASSIST VEHICLE MODULE

CROSS REFERENCE OF RELATED APPLICATIONS

This patent application is a continuation-in-part application of nonprovisional patent application Ser. No. 14/108,710, which claims priority to provisional patent application Ser. No. 61/747,331 filed on Dec. 30, 2012, provisional patent application Ser. No. 61/750,426 filed on Jan. 9, 2013, and provisional patent application Ser. No. 61/827,067 filed on May 24, 2013, and this patent application also claims the benefit of the provisional patent application Ser. No. 61/911,298 filed on Dec. 3, 2013, all of which are hereby incorporated by reference in their entirety.

FIELD OF THE INVENTION

This invention was not made pursuant to any federally-sponsored research and/or development.

The present invention relates to a method and system for collection and processing of the real-time traffic data and using the data in assisting the drivers of vehicles, and the intelligent in-vehicle systems in partially or fully automated vehicles, to select a specific lane for vehicle travel on limited access highways, as well as a recommended vehicle speed.

BACKGROUND

The patent application Ser. No. 14/108,710 titled "Management Center Module for Advanced Lane Management Assist for Automated Vehicles and Conventionally Driven Vehicles" describes a process (ALMA) for improving the selection of the most appropriate freeway lane to select and a target speed for that lane. The use of data from a traffic management center TMC is a key source of information for that process. The prior patent application describes a functional architecture that includes the following modules:

ALMAMC-ALMA Management Center Module

SD-Static Database

ODE-Operator Data Entry

GAVM-Guidance Assist Vehicle Module

The prior patent application describes the overall ALMA functional architecture and provides the computational algorithms, procedures and requirements for the ALMAMC module. The prior patent application also describes the background leading to the need for ALMA and the benefits to be derived from it. Using the data output from the ALMAMC, ODE and SD, and the data structures described in the prior patent application, this patent application describes the computational algorithms, procedures and requirements for the GAVM module.

The GAVM module combines information from the ALMAMC together with information from the vehicle and the driver. It provides information on appropriate lane changes and speed commands to the vehicle. Physically it may be a separate computer based unit, or alternatively the software may be incorporated into the vehicle's Navigation and Control System. "Cloud" computation, external to the vehicle may also be employed. A typical computer-based unit may include a processor or processing system, data and information storage, an input-output system, and a user interaction system.

SUMMARY

It is an object of the present invention to achieve, provide, and facilitate:

The collection and processing of real-time data from the ALMAMC, SD and ODE described above.

The further processing of this data to provide the vehicle's control system or the driver with information on the most appropriate lane to select and the desired speed for that lane.

The vehicle control will be determined not only based on direct external parameters such as those provided by the vehicle sensors, but also the data collected and processed by the TMCs from its own vehicle detectors, cameras, incident reports, scheduled roadway closures and TMC operator input. Additionally, the vehicle's operator may put in some information about the vehicle's characteristics, passenger occupancy and willingness to take highways, pay tolls, and other driving preferences.

BRIEF DESCRIPTION OF THE DRAWINGS

These features, aspects and advantages of the novel Advanced Lane Management Assist for Automated Vehicles will become further understood with reference to the following description and accompanying drawings where.

DESCRIPTION

Introduction.

The patent application titled "Management Center Module for Advanced Lane Management Assist for Automated Vehicles and Conventionally Driven Vehicles" describes a functional architecture for conventionally driven vehicles and for partially and fully automated vehicles to select the most appropriate freeway lane and the most appropriate speed for that lane. The architecture contains the functional module "Guidance Assist Vehicle Module". This patent application provides the details for that module. The prior patent application also describes the emerging increased intensity in the use of traffic lane management controls by operating agencies and the need by motorists and automated vehicles for improved in-vehicle information on lane use.

Basic Functions.

Figure 1:
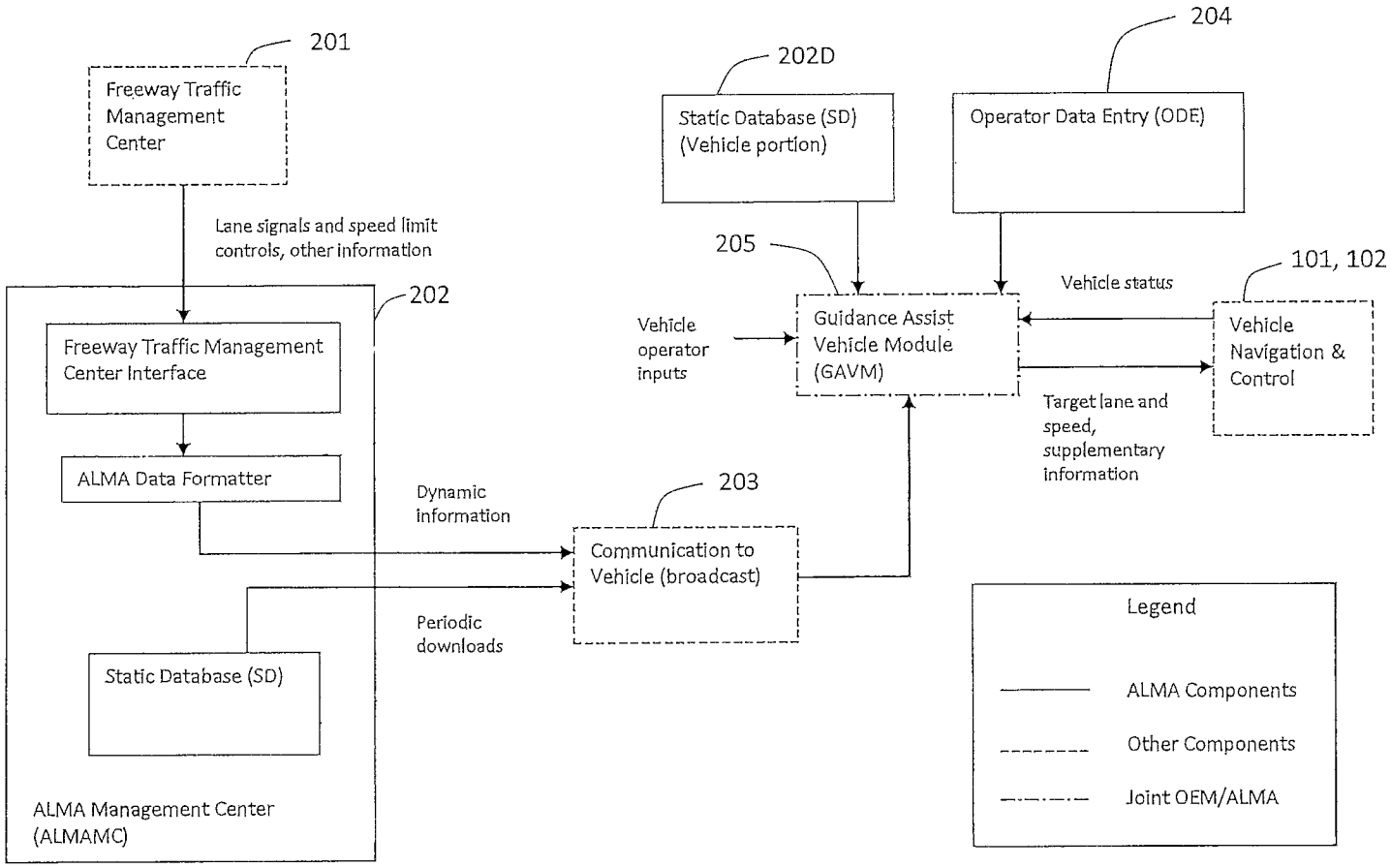
FIG. 1 is the block diagram representation of the ALMA Relationships.

FIG. 1 (reproduced from the prior patent application with appropriate identification notation) provides a functional architecture and the basic data flow relationships for the entire process of transforming information developed by traffic management centers (TMCs) into information that drivers or automated vehicles may use to assist in lane selection and the development of a target speed for that lane. This patent application focuses on the details of the Guidance Assist Vehicle Module 205 (GAVM) in that figure. The basic function of the GAVM 205 is to obtain information from the ALMA Management Center 202, (ALMAMC) and combine it with information from the vehicle operator and from the vehicle itself to provide the lane guidance information. ALMA provides information to vehicles to enable them to respond to information from the freeway traffic management center in a way that is similar or superior to the way that a human driver would respond to the commands.

Inputs to the GAVM 205 from the ALMA Management Center 202 include the following:

Lane speed and other lane based traffic parameters;

Vehicle class. Lanes may be restricted for use by certain vehicle classes*;

Vehicle overheight and overweight restrictions; Lane closure commands*;

Permitted use of shoulders for travel*;

Availability of required vehicle occupancy*; and

Speed limits by lane*.

*This information may vary by time-of-day or by traffic conditions.

Information from the vehicle 101, 102 and the operator 204 includes:

Vehicle location

Driver aggressiveness preferences;

Identification of desired freeway entry and exit locations

Availability of toll tag;

Willingness of vehicle operator to pay toll; and

Number of passengers.

Vehicles using ALMA require a route development capability (navigation system). Using the information described above, the GAVM 205 provides information to select appropriate lanes and provide target speeds. If the GAVM 205 determines that restrictions on the freeway prevent the completion of the planned route, the GAVM 205 notifies the vehicle's navigation system that a different path is required.

Functional Architecture.

FIG. 1, reproduced from patent application titled "Management Center Module for Advanced Lane Management Assist for Automated Vehicles and Conventionally Driven Vehicles" shows the principal data flow relationships among ALMA modules and the freeway traffic management center 201 and the vehicle navigation and control system 101, 102. The Guidance Assist Vehicle Module 205 (GAVM) combines information from the ALMAMC 202 as transmitted by the Communications to Vehicle Module (203) together with information from the vehicle navigation and control system 101, 102 and the vehicle operator 204 and the vehicle portion of the static database 202D. It provides information on appropriate lane changes and speed recommendations to the vehicle control system 102 or to the driver. Physically it may be a separate computer based unit, or alternatively the software may be incorporated into the vehicle's Navigation and Control System 101, 102. Cloud computing facilitates other physical arrangements. The prior patent application describes the relationship and function of the other modules.

The ALMA concept utilizes a data structure (physical division of the freeway into information related segments.) This data structure, consisting essentially of barrels and zones is described in detail in the prior patent application.

Data Inputs to the GAVM.

Table 1 describes a number of the data inputs into the GAVM 205 from the functional modules in FIG. 1.

TABLE 1

GAVM 205 Data Inputs

| | | DATA SOURCE | | |
|---|---|---|---|---|
| Symbol | Parameter | ALMAMC 202 | ODI Operator Data Entry 204 | VNC Vehicle Navigation and Control 101, 102 |
| AVL | Average vehicle length | √ | | |
| AVSPD | Average lane speed in barrel | √ | | |
| BARNORM | Barrel incident status | √ | | |
| CURLANE | Lane vehicle is currently in | | | √ |
| Distset | Distance to begin search for zone next to exit location | | √ | |
| EC | Exit open | √ | | |
| EXZ | Zone vehicle exits from path | | | √ |
| H | Overheight restriction | | √ | |
| INCZONE | Closed lane(s) in this zone | √ | | |
| LC | Lane commands | √ | | |
| LFD | Lane flow direction | √ | | |
| LSS | Lane control ATM command from TMC | | | |
| LVR | Lane vehicle requirements | √ | | |
| PO | Number of vehicle occupants | | √ | |
| SPPUSH | Incremental speed | | √ | |
| SPTMC | Zone speed | √ | | |
| TRA | Toll rate by lane | √ | | |
| TTA | Set of types of toll tags available to vehicle | | √ | |
| TTU | Does driver want to use toll tag for trip | | √ | |
| VC | Vehicle class | | √ | |
| VH | Vehicle height | | √ | |
| VS | Vehicle speed | | | √ |
| VW | Vehicle weight | | √ | |
| ZC | Zone that vehicle is currently in | | | √ |
| ZE | Entry zone to path | | | √ |

ALMAVM Top Level Module and Processes.

ALMA executes its processes through software modules. The in-vehicle processes are computed in the following order:

Module 1—Sequence Identification

Based on barrel and zone information from the vehicle, this module schedules the sequence of computations.

Module 2—Operator and Vehicle Constraints

The lane selection process is influenced and constrained by vehicle characteristics and vehicle operator preferences with regard to the payment of tolls. These constraints include:

The availability of an appropriate toll tag and the operators desire to elect a toll facility Vehicle satisfaction of height restrictions Vehicle satisfaction of weight restrictions Vehicle satisfaction of lane use restrictions. These include adherence to the type of lane use (e.g. HOV) and satisfaction of passenger occupancy requirements Module 3—Adjustment for Vehicle Exit Modules 3 and 4 provide the vehicle with instructions to select the most appropriate lane. The modules identify a "target" or recommended lane to which the vehicle should move. In some cases, the vehicle will traverse the entire portion of the path from the vehicle entry point until the last zone in the barrel. In other cases, the vehicle will exit the path prior to the last zone in the barrel. Module 3 develops the guidance instructions to accommodate vehicles that will exit the freeway shortly. Module 4 develops the guidance instructions for other vehicles.

Module 4—Lane Guidance

Module 4 identifies the target lane. It first identities allowable target lanes based on the presence of incidents, lane drops and vehicle exit requirements. Two alternative sets of lane selection rules are provided by Module 4.3.A and Module 4.3.B.

Module 4.3.A provides a simple set of rules for selecting the target lane. These rules do not consider operator speed preferences, weather and roadway alignment. Module 5 is used in conjunction with this module to select target speed.

Module 4.3.B considers vehicle operator speed preferences, weather and roadway alignment. It provides target lane and target speed. Other rule sets are possible.

Module 5—Speed Guidance for Module 4A

For the lane selected in Module 4A, a rule set for the target or recommended speed for the target lane is described. Other rule sets are possible. If the current zone lane speed for the targeted lane exceeds the speed limit for that lane, the module targets the vehicle speed as the speed limit. If the lane speed is lower than the speed limit, the targeted speed is set to the current speed plus an increment. The increment is intended to push the vehicles speed into a vehicle following condition to avoid unnecessary gaps being developed in the traffic stream.

ALMAVM Module Process Descriptions

Module 1—Sequence Identification

Figure 2:
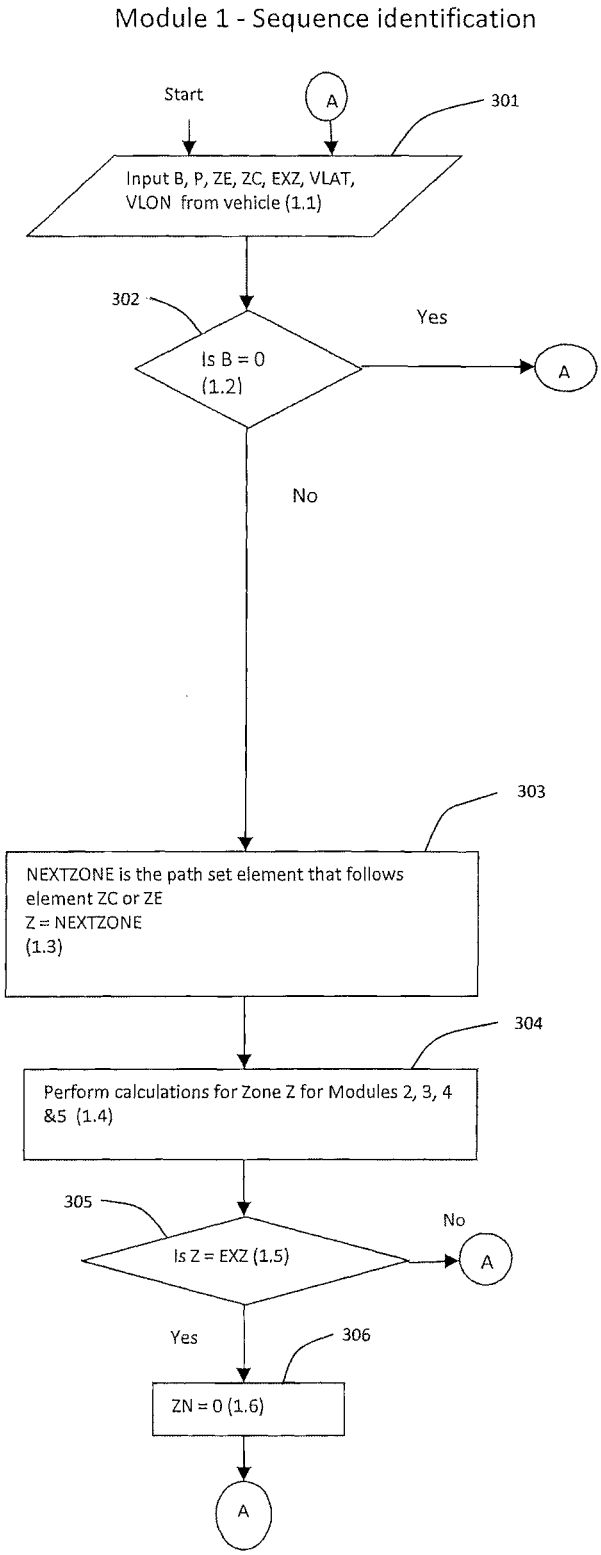
FIG. 2 is the flowchart for the Zone and Sequence Identification Module.

FIG. 2 shows the flow chart for this module. The data structures are described in the patent application titled Management Center Module For Advanced Lane Management Assist for Automated Vehicles and Conventionally Driven Vehicles.

Module 1.1 301 Inputs from Vehicle

The vehicle's mapping function must correlate the vehicle map links with the ALMA barrel and zone structure. Thus when the vehicle is in an entry zone for the ALMA controlled roadway, the vehicle must identify the entry zone and barrel to ALMA. The vehicle must continue to identify the barrel and zone to ALMA. When the calculation is performed for Zone Z (the zone that is subsequent to the zone the vehicle is currently in) the module awaits a new input from the vehicle in order to start the next computational sequence.

Module 1.2 302 Determine if Vehicle is on the Controlled Network or is in an Entry Zone for the Controlled Network Module 1.3 303 Select the Zone for which the Guidance Computation is to be Performed Guidance computations are to be performed for a zone (Z) that is downstream of the zone in which the vehicle is currently located (ZC). The downstream zone is identified from its position in the path set (identified as ZP in Section 4).

Module 1.4 304 Perform Calculations for Zone Z for Modules 2, 3, 4, and 5

This module transfers the sequence of computations to the modules that will develop the guidance information for Zone Z.

Module 1.5 305 Test to Determine Whether Zone Z is the Last Zone in the Barrel that the Vehicle's Path will Traverse If the vehicle will traverse no additional zones in the barrel after Zone Z, no future computations need be performed for this barrel, and a search is instituted for an entry zone in the next barrel in the vehicle's projected route. The last zone that the vehicle will traverse in the barrel is identified as the last element in path set ZP. Note that Zone Z may also serve as an entry zone to the next barrel.

Module 1.6 306 Reset Barrel Index

If the vehicle will enter the last zone in barrel then reset the barrel index to indicate that vehicle will have left barrel after it has exited the zone (the next barrel must be re-identified by the inputs from the vehicle (Module 1.1).

Module 2 Operator and Vehicle Constraints

Figure 4:
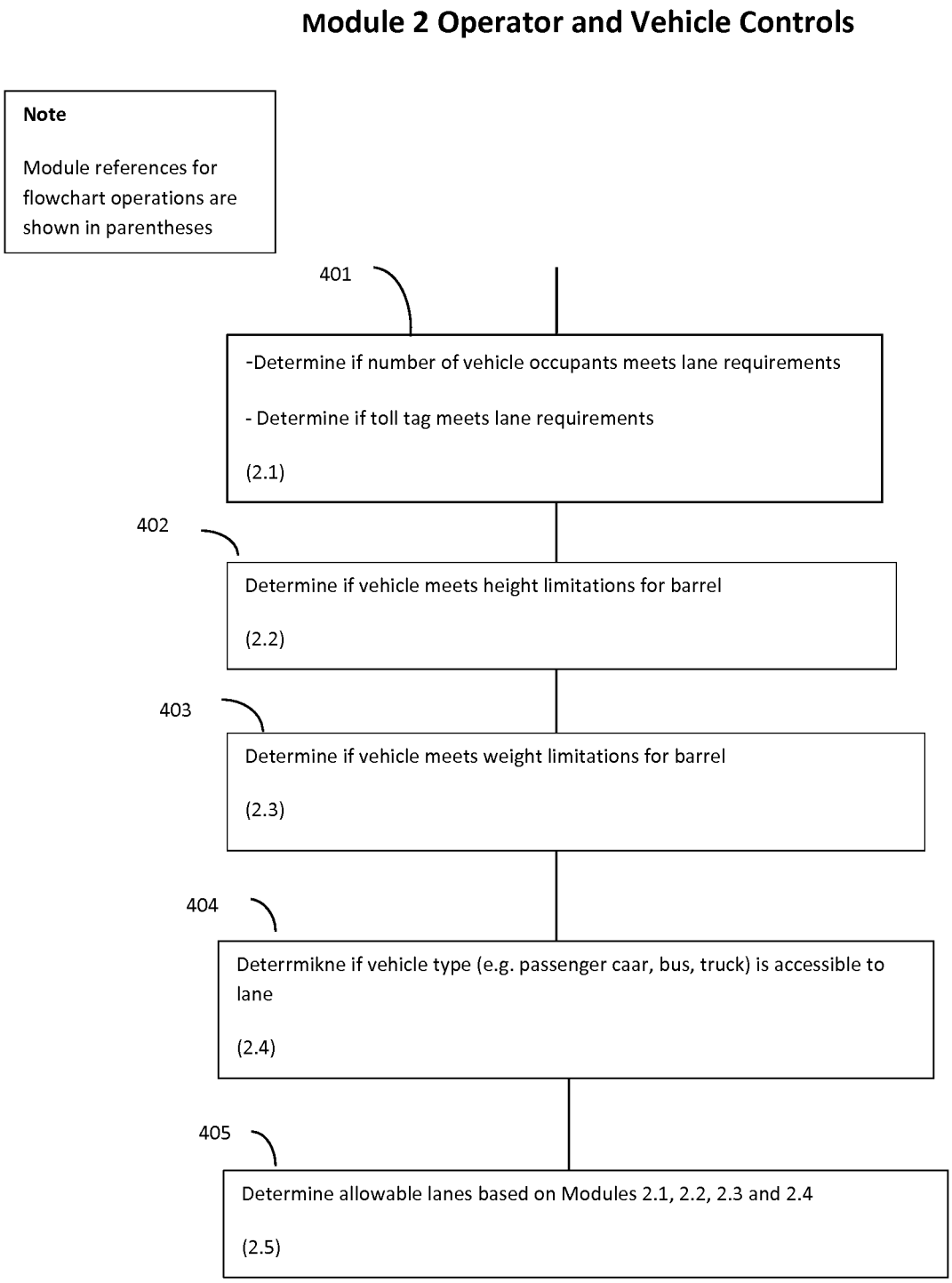
FIG. 4 is a flowchart for Module 2 Operator and Vehicle controls.

This module determines which lanes in a barrel may or may not be available based on the vehicle's classification, characteristics, toll tag availability, and the operator's willingness to pay the toll. Barrels should be defined such that these characteristics are homogeneous throughout the barrel. Below is a representative listing of the pseudocode for these sub-modules. A flow chart is shown in Fig. 4.

Module 2 Pseudocode

Module 2.1 Toll Tag and Vehicle Occupancy Clearance for Lane 401

```
For L = LSTART(B) to LN
TTC(B,L) = 0
If TTL(B,L) = 0    'Chck for HOT lane
  then if LTYPE = HOT            'Indicates that lane is HOT
      then if PO ≥ ON       'Sufficient occupancy so toll not needed
                  then TTC(B,L) = 1
      else    'Check for other than HOT
If TTL = Y
  and (A ∈ TTA)       'A is the type of toll tag. It is tested for membership
                       in the set
TTA
          and (TTU = Y)
                then TTC(B,L) =1
else if
TTL = N       'No toll tag required
  then TTC(B,L) = 1
Next L
```

Note:

TTA and TTU must be entered by vehicle operator

Module 2.2 Overheight Clearance for Barrel 402

```
OC(B) = 0
If VC = A then OC(B) = 1    'Passenger cars are exempt from check
  else if VH ≤ VHL(B) then OC(B) = 1
```

'Note:

VH must be entered by vehicle operator

Module 2.3 Overweight Clearance for Barrel 403

```
OWC(B) = 0
If VC = A then OWC(B) = 1 'Passenger cars are exempt from check
  else if VW ≤ VWL(B) then OWC(B) = 1
```

'Note:

VW must be entered by vehicle operator

Module 2.4 Vehicle Classification Test 404

```
For L = LSTART(B) to LN
LA(B,L) = 0
If VC = A then    'passenger car guidance
  If (LVR(L) ≠ B) and (LVR(L) ≠ C) and (LVR(L) ≠ B)
    then LA(B,L) = 1
If VC = B then 'bus guidance
  If (LVR(L) ≠ A) and (LVR(L) ≠ C)
    then LA(B,L) = 1
If VC = C then 'bus guidance 'truck guidance
  If (LVR(L) ≠ A) and (LVR(L) ≠ B)
    then LA(B,L) = 1
Next L
```

Module 2.5 Determine Allowable Lanes Based on Vehicle, Operator and Roadway Constraints 405

```
If ACT(B) =1 and Z = ZE(B) then    'barrel is active
For L = LSTART(B) to LN
VOK(B,L) = 0
If (LOK(L) = 1) and (TTC(B,L) = 1) and (OC(B) = 1) and
(OWC(B) = 1) and (LA(B,L) =1) then VOK(B,L) = 1
Next L
```

Module 2.1 Toll Tag Clearance for Lane

The module checks to see that the vehicle has an appropriate toll tag if required by the lane and that the operator is willing to pay the toll.

Module 2.2 Overheight Clearance for Barrel

For vehicles other than passenger cars, the module compares vehicle height with barrel requirements.

Module 2.3 Overweight Clearance for Barrel

For vehicles other than passenger cars, the module compares vehicle weight with barrel requirements.

Module 2.4 Vehicle Classification Test

The module compares the vehicle's classification (passenger car, bus, truck) with lane restrictions that may apply.

Module 2.5 Determine Allowable Lanes Based on Vehicle, Operator and Roadway Constraints The module combines the results of modules 2.1, 2.2, 2.3 and 2.4 to determine the lanes that may be used by the vehicle.

Module 3 Adjustment for Vehicle Exit

If the vehicle is to exit the barrel prior to the last link in the barrel, this module develops the appropriate instruction for lane guidance. Below is a representative listing of the pseudocode for this module.

Module 3 Pseudocode

Figure 5:
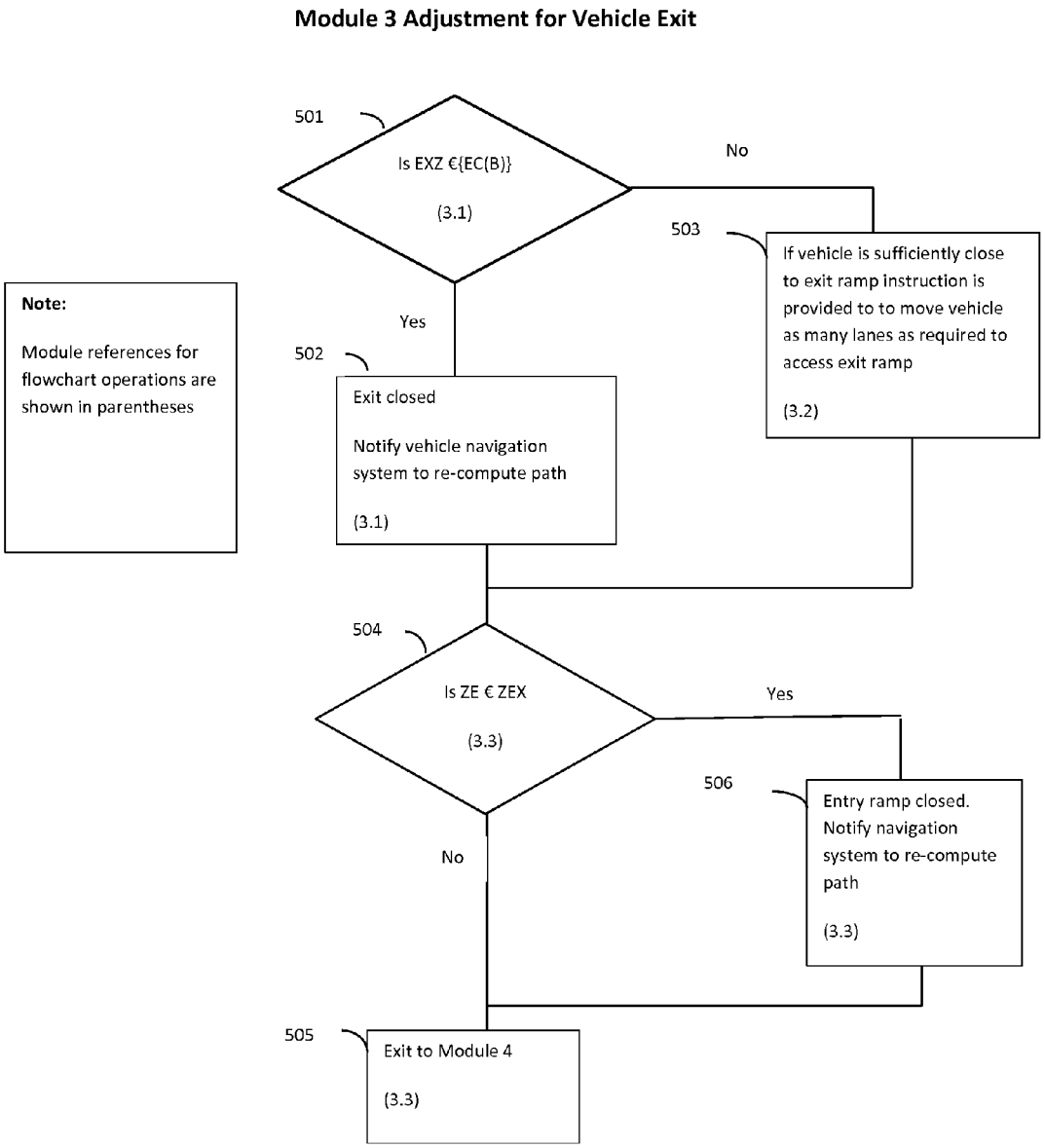
FIG. 5 is a flowchart for Module 3 Adjustment for Vehicle Exit.

Module 3 provides guidance for vehicles that exit the barrel prior to the last zone in the barrel. It activates when the vehicle is sufficiently close to the exit to require preparation to access the exit ramp. (See FIG. 5)

Module 3.1 Check Exit Open 501

The planned exit EXZ is the zone that services the exit ramp. This zone is identified by the vehicle. Information on exits that are closed (EC(B,Z)=0) are communicated to the vehicle from the ALMAMC. They are identified as zones in the barrel that access the exit ramp.

If EXZ not ϵ{EC(B)} then go to Module 3.2 503 'exit is open

Else EXC=True 502 'EXC is the ID for the zone servicing the exit ramp

'Notification must be sent to the vehicle that the ramp serviced by zone EXZ is closed.

In that case, a new value for EXZ is expected from the vehicle.

Module 3.2 Check Exit Proximity 503

```
'Check to see if vehicle is within Distset of zone servicing exit ramp. Distset is in earth arc
degrees, One degree is 0.0105 miles.
'Compute distance between vehicle and zone serving planned exit (EXZ)
DTE = ((PELAT−VLAT)^2 +((PELON − VLON)*cos(VLAT))^2)^0.5
If DTE > Distset then go to Module 3.3          'Vehicle too far from exit to require
504 else                                         proximity guidance
If B = BEX then      'Number of lanes do not change before exit
TARLANE = TAROFF(BEX,EXZ)          'TAROFF is provided by static database. It
is the lane in the zone that accesses the exit ramp
Else ' Exit is close
  If TAROFF(BEX,EXZ) > 1            'Right hand exit
  then if LN(BEX) > LN(B)           Lane add before vehicle exit
    then TARLANE = LN(B)            'Vehicle will move to rightmost lane. If barrel
                                    changes vehicle will move to rightmost lane again
    else TARLANE = 1                'Left hand exit
```

Module 3.3 Check Entry Zone Open 504

'Module receives information on closed entry zones from ALMAMC. If the planned path uses this entry zone, it sends information to the vehicle navigation system requesting a path re-computation.

If ZE=ϵ{ZEX(B)} then EN=1 else EN=0 505

'If EN=1 then planned entry zone is closed 506. Send signal to vehicle navigation module indicating that a route re-computation is required.

Module 3.1 Check Exit Open

Checks to see whether the exit ramp has been closed for any reason.

Module 3.2 Check Exit Proximity

Determines whether the vehicle is sufficiently close to the planned exit ramp to warrant guidance to access the ramp. If sufficiently close, guidance to reach the lane servicing the exit ramp is provided. The test distance (Distset) may be set by the operator.

Module 3.3 Check Entry Zone Open

Checks to see if entry zone is open.

Module 4 Identify Allowable Target Lanes and Select Guidance Algorithm

Figure 6:
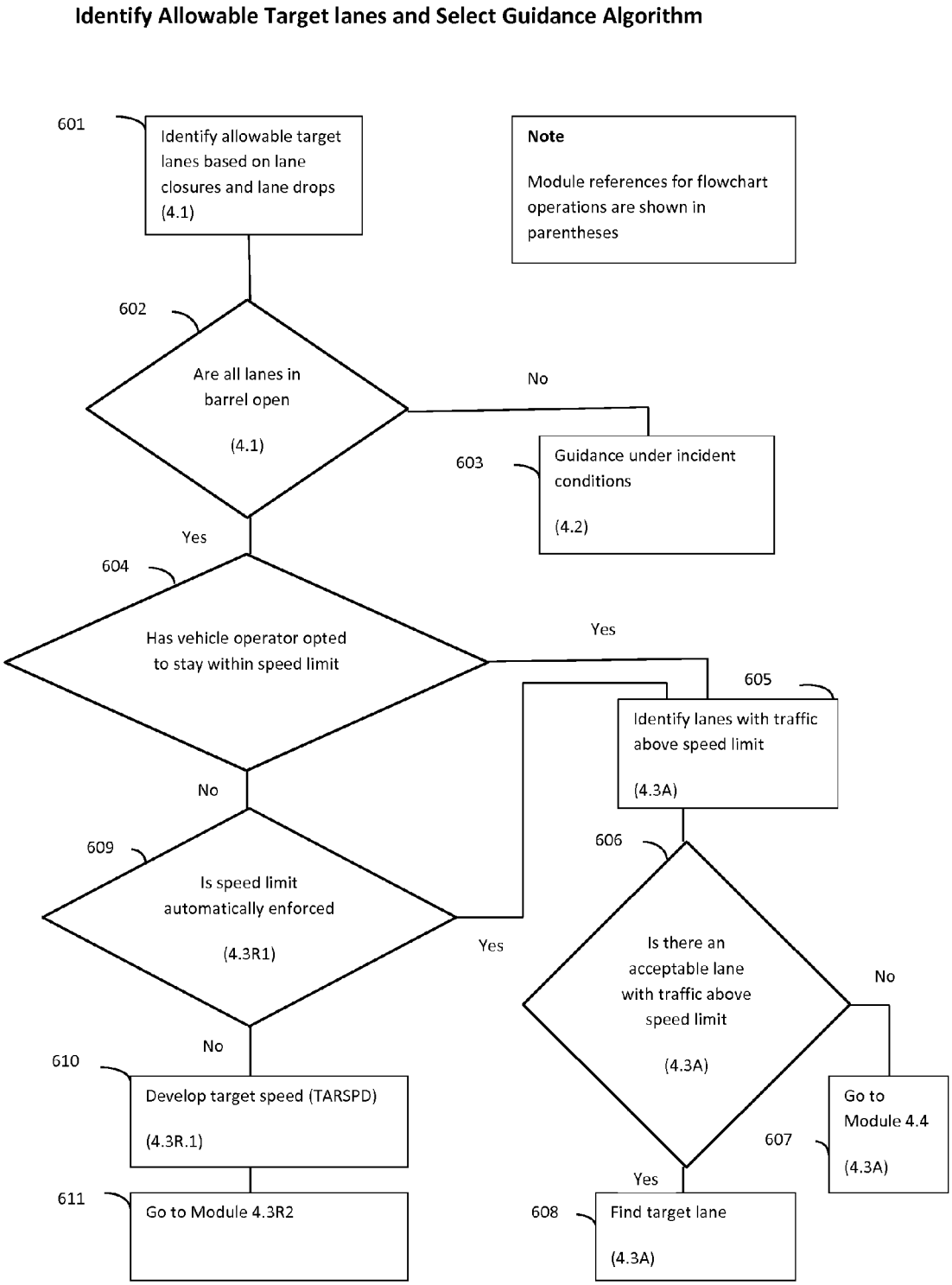
FIG. 6 is a flowchart for Identifying Allowable Target Lanes and Selecting a Guidance Algorithm.

Module 4 (Fig. 6) provides guidance for vehicles that are not located at a short distance from an exit which is before the end of the barrel. It provides guidance under various conditions that include the presence or absence of lane closure incidents, lane speed and whether or not speed limits are automatically enforced. Below is a representative listing of the pseudocode.

Module 4 Pseudocode

Module 4 provides guidance for vehicles that are not located at a short distance from and exit which is before the end of the barrel.

Module 4.1 Identify Allowable Target Lanes and Select Guidance Algorithm

```
'Identify allowable target lanes based on no incident 601
For L = LSTART(B) to LN
  For Z = ZE to ZU
    If (VOK(B,L) =1) and(LSS(B,L,Z) = A
      then LOTV(B,Z,L) =1
        else LOTV(B,Z,L) = 0
  Next Z
Next L
If the vehicle is in the last zone of the barrel and is not exiting here and the first zone of the
downstream barrel has a right lane drop and the vehicle is in the lane to be dropped the provide
guidance to move the vehicle.
If LN(B+1) = LN(B) −1    'Lane drop in next barrel
and ZC = LZ(B)    'Vehicle is in the last zone
and ZC<> EXZ    'Vehicle doesn't exit in this zone
and CURLANE = LN 'Vehicle is in the right lane
then TARLANE(B+1,1) = LN(B+1) 'Moves vehicle to right lane in first zone in next
                                barrel
'Select guidance algorithm 602
'BARNORM is barrel state (normal or incident) as obtained from ALMAMC. If any lane in a
barrel is not fully open (down arrow), BARNORM(B) = 1. This information is transmitted from
the ATMAMC to the Guidance Assist Vehicle Module 205.
If BARNORM(B) = 0 then go to Module 4.3 else go to Module 4.2
```

Module 4.2 Guidance Under Incident Conditions 603

```
'If a lane in a barrel is not fully open and if the vehicle is upstream of the closure point the
strategy is to provide directions to the vehicle to comply with the lane closure information from
the ALMA Management Center 202.
If LSS(B,Z,CURLANE) =E then LC(B,Z,CURLANE) = E    'Vehicle must change lane at earliest
                                                    possible time
  else if LSS(B,Z,CURLANE) =D then LC(B,Z,CURLANE) = D    Vehicle must change
lane at                                                    earliest possible time
    else if LSS(B,ZCURLANE,) =A then LC(B,Z,CURLANE) = A    'Vehicle may
continue in lane
      else LC(B,Z,CURLANE) = H        'vehicle must stop prior to entry into
Zone Z
'In the absence of lane control indications by the traffic management center, the ALMA
Management Center will set LSS(B,Z,CURLANE) = A
```

Module 4.3A Normal Guidance (Speed Stays within Speed Limit) 604

```
'Find average speed of lanes in anticipated vehicle route 605
For L = LSTART(B) to LN
  For Z = ZE to EXZ
    SUMSPD(Z,L) = 0
    SUMSPD(Z,L) = SUMSPD(Z,L) + SPTMC(B,Z,L) + 'SPTMC(B,Z,L) from
ATMAMC
  Next Z
  AVSPD(B,L) = SUMSPD(Z,L)/LN
Next L
'Identify acceptable lanes above speed limit 605
{LNASL} = {}        '{LNASL}is the set of lanes above the speed limit {} is an empty set
For L = LSTART to LN
  LACC(B,L) = 0
  If (LOK(B,L) =1) and (AVSPD(L)) > SL(B,L)) then LACC(B,L) = 1
  {LNASL} = {LNASL} + L    'L is an element added to {LNASL}
  'LACC(B,L) = 0 represents lanes with vehicles below speed limit - use Module 4.4
Next L
'If there is no acceptable lane above the speed limit 606, go to Module 4.4 607
ACCTEST = 0
For L = LSTART to LN
If LACC(B,L) = 1 then ACCTEST = 1
Next L
If ACCTEST = 0 then go to Module 4.4 else do        'TARLANE is the recommended lane.
                                                     Vehicle may move when convenient
```

-continued

```
If OPT = 2 then Go to Module 4.3R else continue
'Find target lane as the allowable lane with the lowest difference between the lane speed and the
lane speed limit above speed limit 608
TARLANE = −1
For each element E in {NASL} do
        Begin
        SPDTEST = 100    'Seed value
        SPDDIF = AVSPD(B,L) − SL(B, E ϵ NASL)
        If SPDDIF < SPDTEST then
            Begin
                TARLANE(B)    = E ϵ C NASL
                SPDTEST = SPDDIF
            End    'If SPDDIF
End    'For each
```

Module 4.3R Guidance with Driver Attitude Input 610

This module describes the functionality for achieving this when the vehicle may change only one lane at a time. The lateral control system should be provided with a request to change lanes when traffic flow is relatively unconstrained and when the following conditions are satisfied:

1. The vehicle is following another vehicle and the following vehicle's driver desires to achieve a faster target speed (Module 4.3R.1).
2. Adjust the vehicle's speed to a stable following condition (Module 4.3R.2)
3. Determine whether the change to another lane will probably result in the achievement of a speed that is closer to the target speed by a meaningful amount. Select the appropriate lane (Module 4.3R.3)
4. If condition 3 is true, determine whether the target lane is likely to have a gap that is acceptable for vehicle merge purposes. If so, request a lane change (module 4.3R.4).

Module 4.3R.1 Develop Target Speed

'Switch to Module 4.5 if speed limits are automatically enforced 609

If AUTOENF(B)=1 then go to Module 4.3A else 'No automatic speed enforcement

Module 4.3R.1 610 develops a target speed (TARSPD) as follows:

TARSPD=TS1(AGR)*WE(B)*RWA*DN

Values for the variables may be developed as follows:

TS1(AGR) Baseline Speed Based on Driver Aggressiveness Factor

Figure 3:
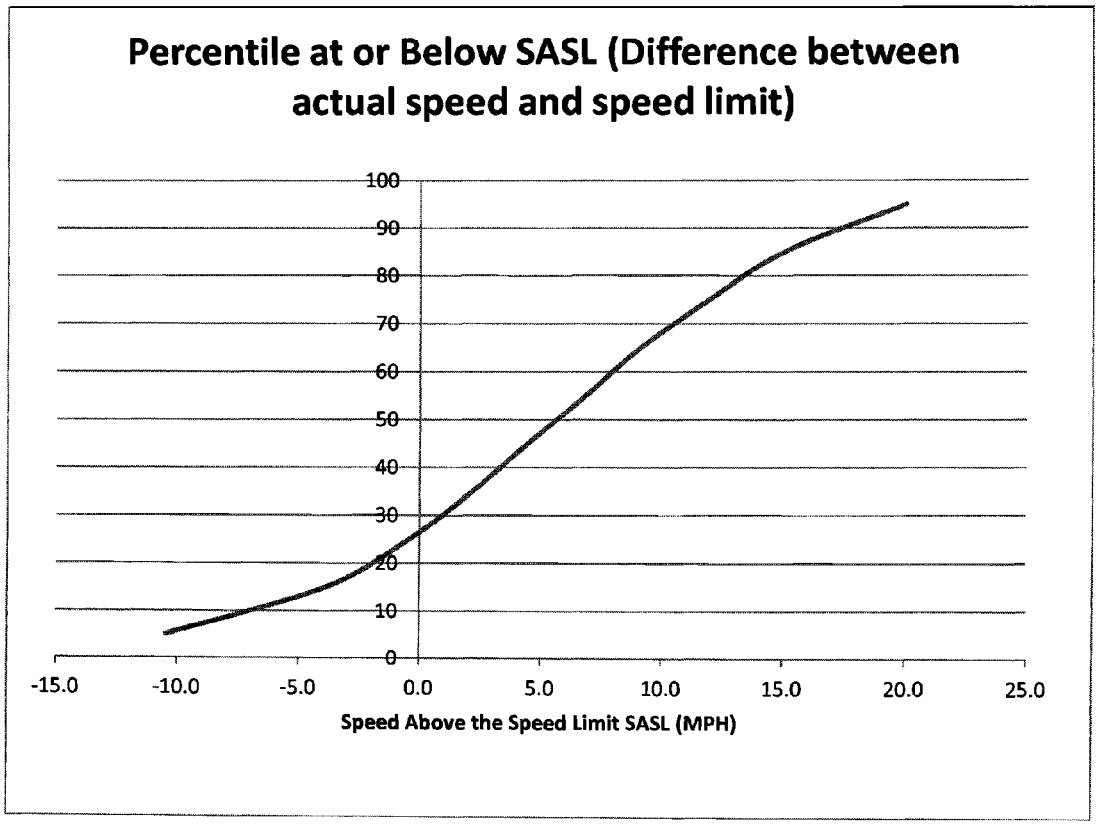
FIG. 3 shows the percentage of vehicles operating at a speed which is below a speed represented by the speed limit plus the difference between the actual motorist speed and the speed limit.

TS1 is the base desired speed (desired speed with fair weather, a favorable roadway alignment and daytime visibility conditions), FIG. 3 plots data from Ahmed (Ahmed, K. I., *Modeling Drivers' Acceleration and Lane Changing Behavior*, Doctoral Thesis, MIT, February 1999) showing the fraction of drivers that drive above the speed limit as a function of the driving speed relative to the speed limit. This figure essentially provides the basis for identifying a target speed based on the aggressiveness of the driver. Table 4.3-1 shows representative values for TS1 and was constructed using this data.

TABLE 4.3-1

Driver Aggressiveness Level

| Aggressiveness Descriptor | Aggressiveness Level (AGR) | Cumulative probability Level | TS1(AGR) MPH above Speed Limit |
|---|---|---|---|
| Aggressive | 1 | 90% | +7.5 |
| Mildly Aggressive | 2 | 75% | +5.0 |
| Average | 3 | 55% | +3.0 |
| Mildly Conservative | 4 | 25% | 0 |
| Conservative | 5 | 10% | −3.0 |

WE(B) Weather Factor

This factor describes the fraction of fair weather speed that is usually achieved when inclement weather is encountered. An example of the factors that may be employed is provided in Table 4.3-2 (Chin, S. M., Franzese, O., Green, D. L., and H. L. Hwang, *Temporary Loss of Highway Capacity and Impacts on Performance*, Oak Ridge National Laboratory, November, 2004.)

TABLE 4.3-2

Reduction in Speed and Capacity

| Weather | Highway type | | | | | | | |
|---|---|---|---|---|---|---|---|---|
| | Urban freeway | | Rural freeway | | Urban arterial | | Rural arterial | |
| condition | Capacity | Speed | Capacity | Speed | Capacity | Speed | Capacity | Speed |
| Liht rain | 4% | 10% | 4% | 10% | 6% | 10% | 6% | 10% |
| Heavy rain | 8% | 16% | 10% | 25% | 6% | 10% | 6% | 10% |
| Light snow | 7.5% | 15% | 7.5% | 15% | 11% | 13% | 11% | 13% |
| Heavy snow | 27.5% | 38% | 27.5% | 38% | 18% | 25% | 18% | 25% |
| Fog | 6% | 13% | 6% | 13% | 6% | 13% | 6% | 13% |
| Ice | 27.5% | 38% | 27.5% | 38% | 18% | 25% | 18% | 25% |

It is not recommended that this factor be applied to short roadway sections, but rather to reflect general conditions in a longer roadway section such as a barrel.

RWA(B) Roadway Alignment Factor

This factor provides an adjustment for target speed reduction when design characteristics for major sections of the roadway (such as a barrel) that feature characteristics that are below interstate standards. These characteristics may include lane width below 12 feet, lack of paved shoulders and tighter horizontal alignments. Estimates of the operating speed for roadway sections with substandard alignments are provided by Table 4.3-3, University of Southern http://www.usq.edu.au/course/material/SVY2301/CIV2701/Lectures/Lectures%207-% 20CIV2701-% 20Design%20Factors%20-% 20Speed.pdf, lecture notes (Design Parameters-Speed)

TABLE 4.3-3

Operating Speeds with Substandard Alignment

| Range of Radii in Section (m) | Single Curve Section Radius (m) | Section Operating Speed (km/h) |
|---|---|---|
| 45-65 | 55 | 50 |
| 50-70 | 60 | 52 |
| 55-75 | 65 | 54 |
| 60-85 | 70 | 56 |
| 70-90 | 80 | 58 |
| 75-100 | 85 | 60 |
| 80-105 | 95 | 62 |
| 85-115 | 100 | 64 |
| 90-125 | 110 | 66 |
| 100-140 | 120 | 68 |
| 105-150 | 130 | 71 |
| 110-170 | 140 | 73 |
| 120-190 | 160 | 75 |
| 130-215 | 175 | 77 |
| 145-240 | 190 | 79 |
| 160-260 | 210 | 82 |
| 180-285 | 235 | 84 |
| 200-310 | 260 | 86 |
| 225-335 | 280 | 89 |
| 245-360 | 305 | 91 |
| 270-390 | 330 | 93 |
| 295-415 | 355 | 96 |
| 320-445 | 385 | 98 |
| 350-475 | 410 | 100 |
| 370-500 | 440 | 103 |
| 400-530 | 465 | 105 |
| 425-560 | 490 | 106 |
| 450-585 | 520 | 107 |
| 480-610 | 545 | 108 |
| 500-640 | 570 | 109 |
| 530+ | 600 | 110 |

DN Nighttime Factor

This factor provides for the situation where roadways may experience speed reduction under darkness conditions.

Module 4.3R.2-Select Lane to Consider for Transfer 611

The average distance between freeway lane changes is approximately 2.8 miles (Lee, S. E., Olsen, E. C. B. and W. W. Wierwille, A Comprehensive Examination of Naturalistic lane Changes, USDOT Report No. DOT HS 809702-), March 2004). The objective of the module is to identify lane changes that will lengthen this distance (saving fuel, reducing crashes and providing smoother ride) while still maintaining the driver's preferences.

Figure 7:
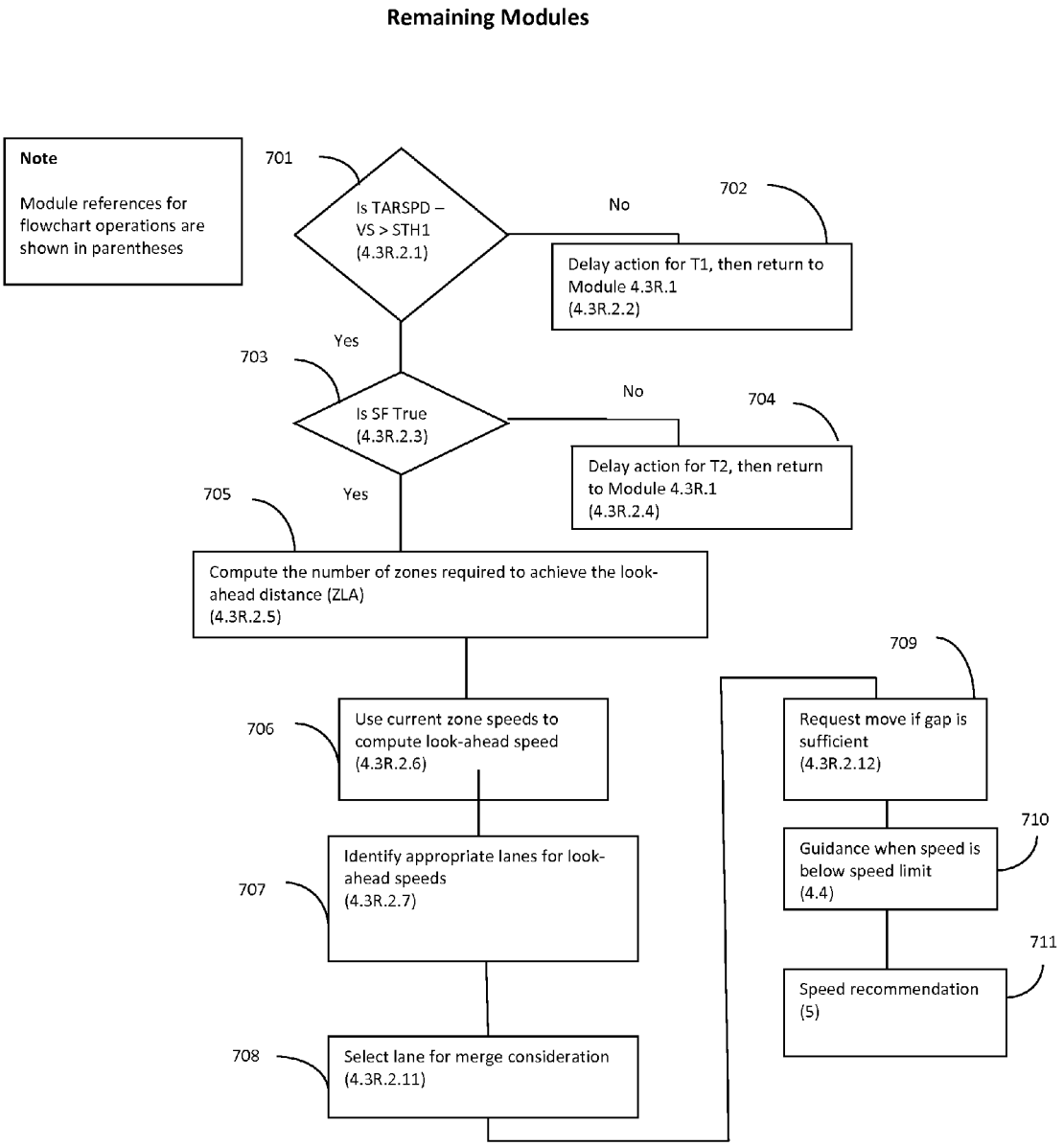
FIG. 7 is a flowchart for information communication between the remaining modules.

The module identifies candidate lanes in which to merge, compares the current speed with the speed ahead in the candidate lanes and recommends the lane to consider further. FIG. 7 shows the flow chart for this module and for the subsequent modules. Sub-module descriptions are provided below.

Module 4.3R.2.1 Comparison of Vehicle Speed to Target Speed 701

If the current vehicle speed is within an acceptable threshold relative to the target speed no further action is required. Otherwise the Module 4.3R.2 module processes will continue.

Module 4.3R.2.2 Delay Action 702

Vehicle is traveling at an acceptable speed, take no further action for a period equal to T1, then return to Module 4.3R.1.

Module 4.3R.2.3 Test for Stable Following 703

Module 4.3R.2 is based on the assumption that the vehicle is following a preceding vehicle with a speed difference that does not vary by more than a preset threshold. Otherwise the gap relative to the preceding vehicle is changing and following is not stable. It is assumed that the vehicle's ACC will provide the difference in the vehicle's speed and the speed of the preceding vehicle (SPPRE). Two tests, at time differences of T2 seconds will be required. Each will be required to show a SPDIF within STTH5 before the remainder of the module is executed.

If SPPRE(T) and SPPRE(T+T2)<|STTH5| then SF=True else SF=False

If SF=True then go to Module 4.3R.2.5 705 else go to Module 4.3R.2.4 704

Module 4.3R.2.4 Delay Action 704

If following is not stable, the driver or ACC must take action to provide stable following before lane changing criteria can be further tested.

Module 4.3R.2.5 Number of Look-Ahead Zones 705

Zone lengths vary. To provide a basis for examining the region ahead of the vehicle a conversion between the desired look-ahead distance and the number of zones required to achieve this distance must be developed and rounded. This module computes the number of look-ahead zones required to approximately satisfy the desired look-ahead distance DLA.

'Find last look ahead zone (ZLA) based on current zone (Z6). ZLA may temporarily exceed number of zones in barrel (will be corrected later)

```
ZLA=ZC+1
While LAD<DLA do
Begin
LAD=LAD+LEN(ZLA+1).
Next ZLA
End
End 'While
```

'Select last zone for look-ahead computation

```
If ZLA>ZL(B) then LASTZONE(B+1)=ZLA−ZL(B)
    else LASTZONE(B)=ZLA(B)
```

Module 4.3R.2.6 Look-ahead Speed Using Current Zone Speeds 706

A length weighed average of zone speeds is computed for the look-ahead distance according to the following expression:

$$\text{Look ahead speed for each lane} = \frac{\sum_{Z+1}^{Last\ zone} \text{Zone speed} * \text{zone length}}{\sum_{Z+1}^{Last\ zone} \text{Zone length}}$$

The algorithm is as follows:

```
SPLEN =0
LENSUM =0
For L = 1 to LN
For ZZ = Z + 1 to LASTZONE
   SPLEN = SPTMC(B,ZZ,L) * ZLEN(B,ZZ)
   LENSUM = ZLEN(B,ZZ)
Next ZZ
ZWAS(L) = SPLEN/LENSUM
Next L
```

Module 4.3R.2.7 Identify Appropriate Speed for Adjacent Lanes 707

```
'CURLANE obtained from vehicle
'Algorithm is based on no use of shoulders as a travel lane. Must be altered if this is not the case.
If CURLANE =1 then LAL = X else if CURLANE − 1 not an opposite flow lane then LAL = CURLANE −1 else LAL = X        'Identifies left look-ahead lane
If LAL ≠ X then SLAL = ZWAS(LAL)        ' Speed for left look-ahead lane
If CURLANE = LN then RAL = X else if CURLANE − 1 not an opposite flow lane then RAL = CURLANE + 1 else RAL = X        'Identifies right look-ahead lane
If RAL ≠ X then SRAL = ZWAS(RAL)        ' Speed for right look-ahead lane
```

Module 4.3R.2.10 Establish Criteria for Lane Change

To this point, it has been determined that the vehicle is not close to the desired speed, look-ahead zones have been established and look-ahead speeds have been developed for these zones. This module establishes the criteria for determining whether a lane change is worthwhile. This criteria could be the subject of future research, therefore this module has been established as a placeholder for the results of such research.

The current criterion is the establishment of a threshold STH4 defined as the speed improvement in look-ahead speeds required to justify the move to an adjacent lane.

Module 4.3R.2.11 Select Lane for Merge Consideration 708

The module tests look-ahead speeds in the current lane and lanes to the left and right of current lane relative to the desired speed. The module selects the highest speed lane that does not exceed the desired speed, provided the speed difference exceeds a threshold STH4.

```
If (SLAL − ZWAS(L)) > STH4 and SLAL < TARSPD then MLAR = OK else MLAL = NOK
'tests left lane indifference to move and target speed compliance
If (SLAR − ZWAS(L)) > STH4 and SLAR < TARSPD then MLAL = OK else MLAR = NOK
'tests right lane indifference to move and target speed compliance
If MLAL ≠ OK and MLAR ≠ OK then go to Module 4.3R.1 610'No lane change
  Else if MLAL = OK and MLAR ≠ OK then MOVELEFT 'consider left lane for gap criteria
    Else if MLAR = OK and MLAL ≠ OK then MOVERIGHT 'consider right lane for gap criteria
      Else if MLAL = OK and MLAR = OK then 'select faster lane
      If SLAL > SLAR then MOVELEFFT else MOVERIGHT
Go to Module 4.3R.2.12
```

Module 4.3R.2.12 Request Move if Gap is Sufficient 709

The preceding sub-modules of Module 4.3 have quantified driver preferences and have constrained the adjacent lane change possibilities by various factors. Some of these constraints are oriented to retaining existing traffic flow conditions and motorists' driving habits as developed for conventional vehicles. This assumption was made for the following reasons:

When market penetration is low, non-conformance with existing traffic patterns will result in modifications to these patterns. While strategies exist that may be acceptable to automated vehicles, they may be discomforting to drivers of conventional vehicles. Initial introductions of this technology should probably avoid these issues.

Strategies that result in roadway capacity changes may have unintended traffic redistribution effects.

Module 4.4 Guidance when Lane Speed is Below the Speed Limit 710

```
Begin
'Direct vehicle to fastest lane when no lanes above the speed limit are available
      DVAR2 = 0    'DVAR2 is temporary parameter
For L = 1 to LN
      If VOK(B,L) = 1 and AVSPD(B,L) > DVAR2 then TARLANE = L
      If AVSPD(B,L) > DVAR2 then DVAR2 = AVSPD(B,L)
Next L
End    'Module 4.4
```

Module 4.1 Identify Allowable Target Lanes and Select Guidance Algorithm

Module 4.1 identifies lanes available based on vehicle characteristics, tolling and operator preferences. Based on closure information from the ALMAMC, if lane in the barrel is not fully open, module 4.2 is selected. Module 4.3 is selected in the event of no lane closures Module 4.2 Guidance Under Incident Conditions If all lanes in the barrel are not fully open (down arrow) the directions provided to the vehicle emulate the lane control signals.

Module 4.3A Normal Guidance if Speed Limits are not Automatically Enforced

The module switches to Module 5 if there is automatic speed enforcement. The module determines which lanes have speeds above the speed limit and directs the vehicle to the lane with the lowest speed above the speed limit. When the control speed is set to the speed limit in Module 5, this will result in the least disruption to traffic in the barrel.

Module 4.3R Guidance with Driver Attitudinal Input

This module provides guidance when driver attitude input is considered along with roadway alignment and weather factors.

Module 4.4 Guidance when Lane Speed is Below the Speed Limit

When all lanes are fully open but the speed in all lanes is below the speed limit, the vehicle is directed to the fastest lane.

Module 5 Lane Speed Guidance 711

Used in conjunction with Module 4.4 710, this module sets a target speed for the target lane.

The target speed is the speed limit or lower.

```
'Compare current zone speed for target lane with current speed limit
If (SPTMC(B,Z,L) = −1 then TARSPD(B,Z,L) = −1 'Speed data not accurate, can't set target
speed
If SPTCM(B,Z,L) = −1 then Go to [A]          'Eliminates next statement if speed is not accurate
If SPTMC(B,Z,L) > SL(B,Z,L) then TARSPD(B,Z,L) = SL(B,Z,L)          'sets to speed limit
        else TARSPD(B,Z,L) = SPTMC(B,Z,L) + SPPUSH 'sets to current lane speed with
                                                    push to close gaps
[A]     'branch to bypass previous statement when necessary
```

Module 5 Speed Guidance 711

For the target lane selected in Module 4, if the if the current zone lane speed for the targeted lane exceeds the speed limit for that lane, the module targets the vehicle speed as the speed limit. If the lane speed is lower than the speed limit, the targeted speed is set to the current speed plus an increment. The increment is intended to push the vehicles speed into a vehicle following condition to avoid unnecessary gaps being developed in the traffic stream.

APPENDIX A

Symbols and Abbreviations

Refer to process descriptions for index referencing

A-Type of toll tag (e.g. EZ Pass)

ACCTEST-Temporary parameter

ACT-Currently relevant barrel activation limits

AGR-Driver aggressiveness level

AUTOENF-Automatic enforcement of speed limit in barrel

AVL-Average vehicle length

AVSPD-Average lane speed in barrel

B-Barrel number-a barrel is a homogeneous section of roadway (number and static or time of day use of lanes remains constant). Barrels may be separated by physical or functional separation. Barrel number must include a reference direction (N or E). E.g. E4

BARNORM-Barrel incident status (0 if normal, 1 if abnormal)

BC-Downstream barrel when vehicle path continues past current barrel

BEX-Barrel containing exit zone

CURLANE-Lane in which vehicle is currently located

D1-Test zone width

Distset-Distance to begin search for exit location prior to end of barrel

DLA-Look-ahead distance threshold

DM-Operator data entry of speed preference mode. Define as follows:

- A-Stay within speed limit
- B-May exceed speed limit (except where automatically enforced)

DN-Nighttime factor

DTE-distance to exit

DVAR Temporary parameter

E-Element in NASL

EC-Set of in barrel that access closed entry ramps

EN-Indicated entry zone state

EXC-Required exit closed (true, false)

EXL-Lane to access exit ramp

EXZ(BEX)-Zone vehicle exits from path (Last zone in path that vehicle traverses prior to exit from barrel)

INCZONE-Set of closed lane(s) in this zone

INTESTZONE-Vehicle in test zone

ITS-Intelligent Transportation Systems

L-Lane ID. Relative to reference direction for barrel even when major or complete flow is in opposite direction. Designate full left shoulder as L=0 (denote as X if shoulder doesn't exist, designate full right shoulder as RS if present. The leftmost normal travel lane is designated as L=1. With opposite flow lanes, add the designator R after the lane ID LA-Lanes available in entire barrel for vehicle LACC-Lane with speed above speed limit. L is the ID number of lane with speed above the speed limit that is acceptable (LACC(B,L)=1) including the other vehicle constraints. LACC(B,L)=0 is below the speed limit LAD-Look-ahead distance LAL-Left look-ahead lane LASTZONE-Last zone for look-ahead averaging Lat-Latitude LC-Lane commands. Define as follows

- A-Left or right merge or straight permitted
- B-Prohibited merge to left
- C-Prohibited merge to right
- D-Required merge to left
- E-Required merge to right
- F-Required merge to left or right
- G-Vehicle not qualified to use lane
- H-Stop vehicle J-Notify vehicle that lane guidance is terminated
K-Straight permitted
LEN-Look-ahead distance
LFD-Lane flow direction
LN-Number of lanes in barrel
LNASL-Set of lanes in barrel with speeds above speed limit
LOK-Certain static lane closure requirements
LONG-Longitude
LOTV Lanes open to vehicle (0=No, 1=Yes)
LSS-Lane control command from ALMAMC
A-Straight permitted
D-Move to left
E-Move to right
F-Lane closed
J-No guidance provided
LSTART-Dynamic lane index (0 indicates open running shoulder, 1 indicates restricted use)
LTEMP-Intermediate parameter
LTYPE-Lane type (LTYPE=HOT for hot lanes else LTYPE=C)
LVR-Lane vehicle requirements. May be dynamic. Define as follows:
A-Passenger cars only
B-Buses only
C-Trucks only
D-No trucks
E-Buses and trucks only
F-No restrictions
LZ-Last zone in barrel
MLAL-Identifies whether OK to move left
MLAR-identifies whether OK to move right
MOVELEFT-Recommendation to vehicle controls to move left
MOVERIGHT-Recommendation to vehicle controls to move right
NEXTZONE-The subsequent zone in the path set
OC-Overheight clearance
ON-Number of vehicle occupants required for of HOV lane or toll free on HOT lane. This is provided in the static database as a function of time-of-day
OPT-Driver selected option for selection of algorithm incorporating motorist preferences
OPT=1 No incorporation of motorist preferences
OPT=2 Incorporation of motorist preferences
OWC-Overweight clearance
P-Path in barrel
PELAT-Latitude of planned exit
PELON-Longitude of planned exit
RAL-Right look-ahead lane
RWA-Roadway alignment factor
PO-Number of vehicle occupants (data from ODE)
SF-Stable following condition
SL-Speed limit
SLAL-Speed for left look-ahead lane
SLAR-Speed for right look-ahead lane
SPDDIF-Difference between average lane speed and speed limit
SPDTEST-Temporary parameter
SPPRE-Difference in vehicle's speed and speed of preceding vehicle
SPPUSH-Incremental speed
SPTMC-Zone speed from ATMAMC
STH4-Speed improvement in look-ahead speeds required to justify the move to an adjacent lane
STTH5-Threshold for vehicle following test
SUMSPD-Sum of zone speeds (intermediate computation)
T2-Time difference for stable car following test
TARLANE-Target lane
TAROFF-Lane next to exit ramp or lane for connector ramp (static database)
TARSPD-Target speed for lane in zone, −1 indicates that data is not available
TRA-Toll rate by lane
TS1-Miles per hour above speed limit
TTA-Set of types of toll tags available to vehicle
A-E-ZPass
TTC-Vehicle cleared for toll tag use
TTL-Toll tag requirement for lane (Y/N)
TTU-Does driver want to use toll tag for trip (Y/N)
VC-Vehicle class
A-Passenger car
B-Bus
C-Truck
VH-Vehicle height-Ft
VHL-Vehicle height limit
VLAT-Vehicle latitude (from GPS)
VLON-Vehicle longitude (from GPS)
VOK-Vehicle & toll characteristics OK for lane
VS-Vehicle speed
VW-Vehicle weight-Wt
VWL-Vehicle weight limit
WE-Weather factor
Z-Zone ID in barrel for which computation is to be performed
ZC-Zone that vehicle is currently in
ZE-Entry zone to path
ZEX-Set of closed entry zones in barrel
ZL-Last zone in barrel
ZLA-Last look-ahead zone
ZLEN-Zone length
ZP-Zone path (set)
ZU-Number of zones in path
ZWAS-Look ahead speed for each lane

What is claimed is:

1. A method of assisting in selection of driving lanes and target speeds for a vehicle, comprising the steps of:

a. receiving real-time processed lane-specific limited-access highway conditions data from an Advanced Lane Management Assist Management Center (ALMAMC) downstream of the vehicle, said real-time processed lane-specific limited-access highway conditions data being generated from a combination of real-time unprocessed lane-specific limited-access highway data from a traffic management center (TMC) with data from a static database, wherein the real-time processed lane-specific limited-access highway conditions data conforms to a data structure comprising barrels divided into zones, wherein boundaries of the barrels are defined by physical roadway configuration changes and permanent changes in regulatory use of the limited-access highway lanes and wherein boundaries of the zones are defined by changes in traffic conditions along the limited-access highway resulting from entry ramps and exit ramps and locations of motorist information devices and regulatory devices that provide changeable information and active traffic management control of the limited-access highway;

b. determining the vehicle's characteristics, requirements and constraints including freeway exit requirements for the trip, vehicle speed and vehicle location based on data entry of an operator of the vehicle and data from the vehicle;

c. combining the real-time processed lane-specific limited-access highway conditions data with the data from the vehicle, the data from the operator of the vehicle and the data from the static database in the vehicle to create a recommendation to the operator of the vehicle comprising at least one of lane recommendation and speed recommendation using a copy or a subset of the static database; and d. providing the recommendation to the operator of the vehicle or to the vehicle from a guidance assist vehicle module.

2. The method of claim 1, further comprising determining the operator's preferences including at least one of toll preferences, vehicle passenger occupancy, highway use preferences, availability of a toll tag, desired freeway entry and exit locations, and driver aggressiveness preferences.

3. The method of claim 1, wherein the real-time processed lane-specific limited-access highway conditions data from the ALMAMC includes one or more of average vehicle speeds by lane, roadway incident status, lane blockages, lane closures, roadway lane traffic controls and speed advisories, weather, traffic information, limitations on lane use, shoulder information, regulatory lane use data, scheduled roadway closures, dynamic speed limits, current lane speed, volume and occupancy vehicle detector data, camera data, vehicle class based lane restrictions, vehicle overheight restrictions, vehicle overweight restrictions, vehicle occupant calls, and toll information.

4. The method of claim 1, wherein the real-time processed lane-specific limited-access highway conditions data from the ALMAMC is processed by a system for assisting in selection of driving lanes and target speeds for vehicles, the system comprising:

a. at least one interface for receiving real-time processed lane-specific limited-access highway conditions data from the ALMAMC;

b. a processor coupled to the at least one interface, wherein the processor receives the real-time processed lane-specific limited-access highway conditions data from the ALMAMC through the at least one interface, transforms the real-time processed lane-specific limited-access highway conditions data, and transmits transformed real-time processed lane-specific limited-access highway data to the vehicle in a form appropriate for limited-access highway lane selection and target speed selection for the chosen lanes; and c. one or more of a lane closure guidance module, lane and speed limit requirements module, dynamic lane use requirements module, toll information module, module for checking detector values for accuracy, module for formatting traffic data, miscellaneous data module, and static database module, said one or more module operatively coupled to the processor for developing driving lane and target speed selection.

5. The method of claim 1, further comprising using a non-transitory, computer-implemented, roadway zone based spatial data structure to compute the appropriate lane and target speed, said data structure comprising:

a. at least one interface for receiving real-time processed lane-specific limited-access highway conditions data from the ALMAMC; and b. a processor coupled to the at least one interface, wherein the processor receives the real-time processed lane-specific limited-access highway conditions data from the ALMAMC through the at least one interface, transforms the real-time processed lane-specific limited-access highway conditions data using the data structure comprising barrels divided into zones, wherein boundaries of the barrels are defined by physical roadway configuration changes and permanent changes in regulatory use of the limited-access highway lanes and wherein boundaries of the zones are defined by changes in traffic conditions along the limited-access highway resulting from entry ramps and exit ramps and locations of motorist information devices and regulatory devices that provide changeable information and active traffic management control of the limited-access highway, and provides the transformed real-time processed lane-specific limited-access highway data to the vehicle in a form appropriate for limited-access highway lane selection and target speed selection for the chosen lanes.

6. The method of claim 1, further comprising processing the one or more of the real-time processed lane-specific limited-access highway conditions data, the data from the static database, the data from the operator of the vehicle and the data from the vehicle in the vehicle or at a site external to the vehicle to develop the lane recommendation and speed recommendation.

7. The method of claim 1, further comprising using the lane recommendation and speed recommendation by a driver operating a conventional vehicle or by an automated or semi-automated vehicle.

8. The method of claim 1, wherein the real-time processed lane-specific limited-access highway conditions data from the ALMAMC includes one or more of lane volume, lane passenger car equivalent volume, lane average headway, lane density, lane speed, vehicle length by lane, static and dynamic regulatory lane-use data.

9. The method of claim 1, wherein appropriate information decision zones relating to roadway geometries and roadway traffic information devices are established, and wherein the real-time processed lane-specific limited-access highway conditions data corresponding to the information decision zones is provided to the vehicle sufficiently in advance of an action required by the vehicle or the operator to facilitate safe lane changes and speed adjustments in conformance with individual motorist driving preferences.

10. The method of claim 1, further comprising using the real-time processed lane-specific limited-access highway conditions data in conjunction with software in the vehicle.

11. The method of claim 1, further comprising using the real-time processed lane-specific limited-access highway conditions data in conjunction with data provided by the vehicle.

12. The method of claim 1, further comprising periodically providing data to the static database in the vehicle according to the roadway zone based data structures to update the copy or the subset of the static database in the vehicle.

13. A system for assisting in selection of driving lanes and target speeds of a vehicle, comprising:

a. a first interface for receiving real-time processed lane-specific limited-access highway conditions data from an Advanced Lane Management Assist Management Center (ALMAMC);

b. a processor coupled to the first interface, wherein the processor (i) receives the real-time processed lane-specific limited-access highway conditions data from the ALMAMC through the first interface, (ii) transforms the real-time processed lane-specific limited-access highway conditions data, conforming to a data structure comprising barrels divided into zones, wherein boundaries of the barrels are defined by physical roadway configuration changes and permanent changes in regulatory use of the limited-access highway lanes and wherein boundaries of the zones are defined by changes in traffic conditions along the limited-access highway resulting from entry ramps and exit ramps and locations of motorist information devices and regulatory devices that provide changeable information and active traffic management control of the limited-access highway, with data from a static database in the vehicle, the data from the vehicle and the data from an operator of the vehicle to generate transformed real-time processed lane-specific limited-access highway conditions data, and (iii) creates a recommendation to a driver of the vehicle or to the vehicle comprising at least one of lane recommendation and speed recommendation; and c. one or more of a lane closure guidance module, lane and speed limit requirements module, dynamic lane use requirements module, toll information module, module for checking detector values for accuracy, module for formatting traffic data, miscellaneous data module, and static database module, said one or more module operatively coupled to the processor for developing driving lane and target speed selection.

14. The system of claim 13, further comprising a second interface for receiving data from the operator of the vehicle, wherein the processor is coupled to the second interface and processes the data from the vehicle and the data from the operator of the vehicle with the real-time processed lane-specific limited-access highway conditions data and the data from the static database in the vehicle to create a recommendation to the operator of the vehicle or to the vehicle.

15. The system of claim 14, further comprising a computer storage for storing the lane recommendation data and the speed recommendation data, said computer storage being coupled to the processor, wherein the processor receives the lane recommendation data and the speed recommendation data and outputs the lane recommendation data and the speed recommendation data to the computer storage.

16. The system of claim 15, further comprising a transmitter operatively coupled to the computer storage for transmitting the lane recommendation data and the speed recommendation data to the one or more vehicles.

17. The system of claim 13, further comprising a computer storage for storing the lane recommendation data and the speed recommendation data, said computer storage being coupled to the processor, wherein the processor receives the lane recommendation data and the speed recommendation data and outputs the lane recommendation data and the speed recommendation data to the computer storage.

18. The system of claim 17, further comprising a transmitter operatively coupled to the computer storage for transmitting the lane recommendation data and the speed recommendation data to the one or more vehicles.

19. A method of assisting in selection of driving lanes and target speeds for a vehicle, comprising the steps of:

a. receiving real-time processed lane-specific limited-access highway conditions data from downstream of the vehicle, said real-time processed lane-specific limited-access highway conditions data being generated from a combination of real-time unprocessed lane-specific limited-access highway data from a traffic management center (TMC) with data from a static database, wherein the real-time processed lane-specific limited-access highway conditions data conforms to a data structure comprising barrels divided into zones, wherein boundaries of the barrels are defined by physical roadway configuration changes and permanent changes in regulatory use of the limited-access highway lanes and wherein boundaries of the zones are defined by changes in traffic conditions along the limited-access highway resulting from entry ramps and exit ramps and locations of motorist information devices and regulatory devices that provide changeable information and active traffic management control of the limited-access highway;

b. determining the vehicle's characteristics, requirements and constraints including freeway exit requirements for the trip, vehicle speed and vehicle location based on data entry of an operator of the vehicle and data from the vehicle;

c. combining the real-time processed lane-specific limited-access highway conditions data with the data from the vehicle, the data from the operator of the vehicle and the data from the static database in the vehicle to create a recommendation to the operator of the vehicle comprising at least one of lane recommendation and speed recommendation using a copy or a subset of the static database; and d. providing the recommendation to the operator of the vehicle or to the vehicle from a guidance assist vehicle module.

20. The method of claim 19, wherein the processed lane-specific limited-access highway conditions data is generated by a computer or combination other than the Advanced Lane Management Assist Management Center (ALMAMC), with the computer or combination including a peer-to-peer computing scheme, a distributed computing network scheme, and/or a cloud-based computing scheme.

* * * * *